US008992000B2

(12) United States Patent
Sasaki

(10) Patent No.: US 8,992,000 B2
(45) Date of Patent: Mar. 31, 2015

(54) RECORDING APPARATUS AND DRYING METHOD

(71) Applicant: Seiko Epson Corporation, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/341,415

(22) Filed: Jul. 25, 2014

(65) Prior Publication Data

US 2015/0029279 A1 Jan. 29, 2015

(30) Foreign Application Priority Data

Jul. 29, 2013 (JP) ..... 2013-157132

(51) Int. Cl.
*B41J 2/01* (2006.01)
*B41J 11/00* (2006.01)

(52) U.S. Cl.
CPC ..... *B41J 11/002* (2013.01)
USPC ..... 347/102

(58) Field of Classification Search
None
See application file for complete search history.

(56) References Cited

U.S. PATENT DOCUMENTS

2005/0151815 A1 7/2005 Kanai et al.
2009/0244234 A1 * 10/2009 Shiohara et al. ..... 347/102

FOREIGN PATENT DOCUMENTS

| | | |
|---|---|---|
| JP | 2009-073023 | 4/2009 |
| JP | 2009-233858 | 10/2009 |
| JP | 4429923 | 12/2009 |
| JP | 2012-045855 | 3/2012 |
| JP | 2012-232532 | 11/2012 |
| JP | 2013-028094 | 2/2013 |
| WO | 2012/153694 | 11/2012 |

* cited by examiner

*Primary Examiner* — Lisa M Solomon
(74) *Attorney, Agent, or Firm* — Workman Nydegger

(57) ABSTRACT

A recording apparatus includes: a medium support section that supports a recording medium; and an electromagnetic wave irradiation section that dries ink present on the recording medium by irradiating electromagnetic waves to the recording medium on the medium support section, in which the medium support section has a first region including an irradiation region of the electromagnetic wave irradiation section and a second region provided adjacent to the first region, having thermal conductivity lower than that of the first region, and including a non-irradiating region of the electromagnetic wave irradiation section, and is provided with an opening section through which vapor evaporated from the ink passes.

9 Claims, 5 Drawing Sheets

RECORDING APPARATUS AND DRYING METHOD

BACKGROUND

1. Technical Field

The present invention relates to a recording apparatus and a drying method.

2. Related Art

In the related art, recording apparatuses including a heater for drying ink ejected onto a recording medium are used. Among them, a recording apparatus including an electromagnetic wave irradiation section irradiating electromagnetic waves to the recording medium in order to dry the ink ejected onto the recording medium, is frequently used. For example, a recording apparatus including a heater irradiating the electromagnetic waves such as a halogen heater or a sheath heater is disclosed in JP-A-2013-28094 and JP-A-2012-45855.

Further, in JP-A-2013-28094 and JP-A-2012-45855, a recording apparatus is disclosed which includes a platen that supports the recording medium in a transportation route of the recording medium and a heater that corresponds to a position of the platen. Here, in JP-A-2013-28094, a recording apparatus is disclosed in which a plurality of platens made of an aluminum alloy are provided adjacent to each other in a transportation direction of the recording medium.

However, in the recording apparatus of the related art including the heater of the electromagnetic wave irradiation type irradiating infrared rays or the like as disclosed in JP-A-2013-28094 and JP-A-2012-45855, vapor evaporated from the ink ejected onto the recording medium by the heater may be condensed in a medium support section and the recording medium may be wet.

SUMMARY

An advantage of some aspects of the invention is to suppress dew condensation of vapor evaporated from ink by electromagnetic wave irradiation in a medium support section.

According to an aspect of the invention, a recording apparatus includes: a medium support section that supports a recording medium; and an electromagnetic wave irradiation section that dries ink present on the recording medium by irradiating electromagnetic waves to the recording medium on the medium support section, in which the medium support section has a first region including an irradiation region of the electromagnetic wave irradiation section and a second region provided adjacent to the first region, having thermal conductivity lower than that of the first region, and including a non-irradiating region of the electromagnetic wave irradiation section, and is provided with an opening section through which vapor evaporated from the ink passes.

Here, the term "the first region including the irradiation region" of the medium support section means the first region may include at least a part of the irradiation region and means the non-irradiating region may be included. Further, the term "the second region including the non-irradiating region" of the medium support section means the second region may include at least a region which is the non-irradiating region and in which the dew condensation is likely to occur, and means the irradiation region may be included.

Further, the term "the opening section" in "the opening section through which the vapor evaporated from the ink passes" of the medium support section means an opening through which the evaporated vapor is capable of passing from the side of the recording medium to the opposite side with respect to the medium support section.

In this case, the opening section through which the vapor evaporated from the ink passes is provided in the medium support section. Thus, it is possible to release the vapor evaporated from the ink by the electromagnetic wave irradiation through the opening section, in a direction away from the portion of the medium support section facing the recording medium, that is, the contact region between the medium support section and the recording medium. Therefore, it is possible to easily reduce existence amount of the vapor that is a source of the dew condensation in the periphery of the medium support section and then the periphery of the medium support section becomes a state where the dew condensation is unlikely to occur.

Further, in this case, the medium support section has the first region including the irradiation region and the second region having the thermal conductivity lower than that of the first region and including the non-irradiating region. The temperature of first region is likely to increase and the dew condensation is unlikely to occur in the first region because the first region includes the irradiation region. Further, the second region includes a region that is the non-irradiating region and in which the dew condensation is likely to occur, but since the thermal conductivity thereof is lower than that of the first region, the second region becomes a state where the dew condensation is unlikely to occur.

That is, in this case, it is possible to suppress the dew condensation of the vapor evaporated from the ink by the electromagnetic wave irradiation in the medium support section by combination of the first region (including the irradiation region) and the second region (having the thermal conductivity lower than that of the first region and including the non-irradiating region) of the medium support section. Therefore, it is possible to reduce a concern of contamination due to wetting of the recording medium.

Moreover, the configuration in which the second region of the medium support section has the thermal conductivity lower than that of the first region may be realized by a configuration in which the first region and the second region are formed of configuration materials having thermal conductivities different from each other, and, the configuration may be realized, for example, a configuration in which the support surface of the recording medium in the second region and a support surface of the first region are formed of the same configuration material, and the thermal insulation material is provided on the opposite side of the support surface of the second region.

It is preferable that the second region be provided adjacent to at least one side of the first region in a longitudinal direction of the recording medium.

In this case, it is possible to effectively suppress the dew condensation of the vapor evaporated from the ink by the electromagnetic wave irradiation in the medium support section in the longitudinal direction of the recording medium.

It is preferable that the second region be provided with a thermal insulation material.

In this case, the second region is provided with the thermal insulation material. Thus, it is possible to simply form the second region having the thermal conductivity lower than that of the first region by forming the support surface of the recording medium with the same configuration material in the first region and the second region and by providing the thermal insulation material on the opposite side of the support surface in the second region. That is, it is possible to suppress the dew condensation of the vapor evaporated from the ink by the electromagnetic wave irradiation in the medium support section with a simple configuration.

It is preferable that the thermal insulation material be provided in a position in which the temperature is lower than a flash point of a liquid droplet generated by dew condensation of the vapor when irradiating the electromagnetic waves.

Here, for example, the term "the flash point of the liquid droplet generated by the dew condensation of the vapor" corresponds to a flash point of components contained in the ink and, specifically, corresponds to the lowest flash point of the contained components of the ink.

In this case, the thermal insulation material is provided in the position of which the temperature is lower than the flash point of the liquid droplet generated by dew condensation of the vapor when irradiating the electromagnetic waves. Thus, even if the vapor evaporated from the ink is condensed in the thermal insulation material, since the liquid droplet that is generated by the dew condensation is not flammable, safety is high.

It is preferable that the thermal insulation material have thermal conductivity of less than 0.1 W/(m·K).

In this case, the thermal insulation material has the thermal conductivity of less than 0.1 W/(m·K). Thus, the thermal insulation material can effectively lower the thermal conductivity of the second region. That is, it is possible to effectively suppress the dew condensation of the vapor evaporated from the ink by the electromagnetic wave irradiation in the medium support section.

It is preferable that the recording apparatus further include a dew condensation section in which the vapor passing through the opening section is condensed.

Here, the term "the dew condensation section" means the dew condensation section is configured such that the vapor in contact with the surface thereof is more easily condensed than in the medium support section during a drying process. Specifically, for example, the dew condensation section is made of a material such as an aluminum alloy having a high thermal conductivity, and is configured to have a low temperature to cause dew condensation of the vapor contacting therewith. Moreover, of course, the invention is not limited to the configuration of the example.

In this case, the opening section through which the vapor evaporated from the ink passes is provided and the dew condensation section condensing the vapor passing through the opening section are included in the medium support section. Thus, the vapor evaporated from the ink reaches the dew condensation section through the opening section and is positively condensed in the dew condensation section.

Therefore, it is possible to condense the vapor in the dew condensation section before the vapor evaporated from the ink is condensed in the medium support section. That is, it is possible to effectively suppress the dew condensation of the vapor evaporated from the ink by the electromagnetic wave irradiation in the medium support section.

It is preferable that the dew condensation section be provided facing the opening section and the thermal conductivity of the dew condensation section be higher than that of the second region.

In this case, the thermal conductivity of the dew condensation section is higher than that of the second region. That is, the dew condensation section is configured of a material such that the vapor is more likely to be condensed than in the second region. Thus, it is possible to positively condense the vapor evaporated from the ink by the electromagnetic wave irradiation in the dew condensation section and then it is possible to effectively suppress the dew condensation in the medium support section.

It is preferable that an irradiation length of electromagnetic waves of the electromagnetic wave irradiation section in a lateral direction of the recording medium be equal to or greater than a length of the medium support section in the lateral direction.

Here, the term "the length of the medium support section in the lateral direction" may be a length including the length of the outer frame if the medium support section has the outer frame and the like, and may be a length of a region provided with the opening section excluding the length of the outer frame.

Further, the term "equal to" of "equal to or greater than the length of the medium support section in the lateral direction" includes a case of being slightly shorter than the length of the medium support section in the lateral direction.

In this case, the irradiation length of electromagnetic waves of the electromagnetic wave irradiation section in the lateral direction is equal to or greater than the length of the medium support section in the lateral direction. Therefore, it is possible to reduce a temperature distribution of the medium support section in the lateral direction, that is, a portion in which a temperature difference is great does not exist, and then it is possible to suppress the dew condensation in the end section and the like of the medium support section in the lateral direction.

According to another aspect of the invention, a drying method includes: drying ink by performing electromagnetic wave irradiation on the ink present on a recording medium, in which the drying is performed on a medium support section which has a first region including an electromagnetic wave irradiation region, and a second region provided adjacent to the first region, having thermal conductivity lower than that of the first region, and including an electromagnetic wave non-irradiating region and which is provided with an opening section through which vapor evaporated from the ink by the electromagnetic wave irradiation passes.

In this case, the medium support section has the configuration unlikely to condense the vapor evaporated from the ink that is used in recording on the recording medium by irradiating the electromagnetic waves. Thus, it is possible to suppress the contamination of the recording medium due to the dew condensation of the vapor evaporated from the ink by the electromagnetic wave irradiation in the medium support section.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment, FIGS. 1 to 4

Hereinafter, a recording apparatus of a first embodiment is described in detail with reference to the accompanying drawings.

First, the recording apparatus according to the embodiment is described. The recording apparatus is a recording apparatus capable of recording on a recording medium with an aqueous ink, but is not limited to the recording apparatus capable of using the aqueous ink. Further, the recording apparatus is a so-called after heater type recording apparatus including a medium support section of the invention at a position different from a recording region (a position capable of facing a nozzle surface of a recording head), but is not limited to the recording apparatus and may be a recording apparatus including the medium support section of the invention in the recording region. Further, the recording apparatus is a recording apparatus that performs recording by transporting the recording medium with respect to the recording head, but may be a so-called flatbed type recording apparatus that moves the recording head with respect to the medium support section.

Figure 1:
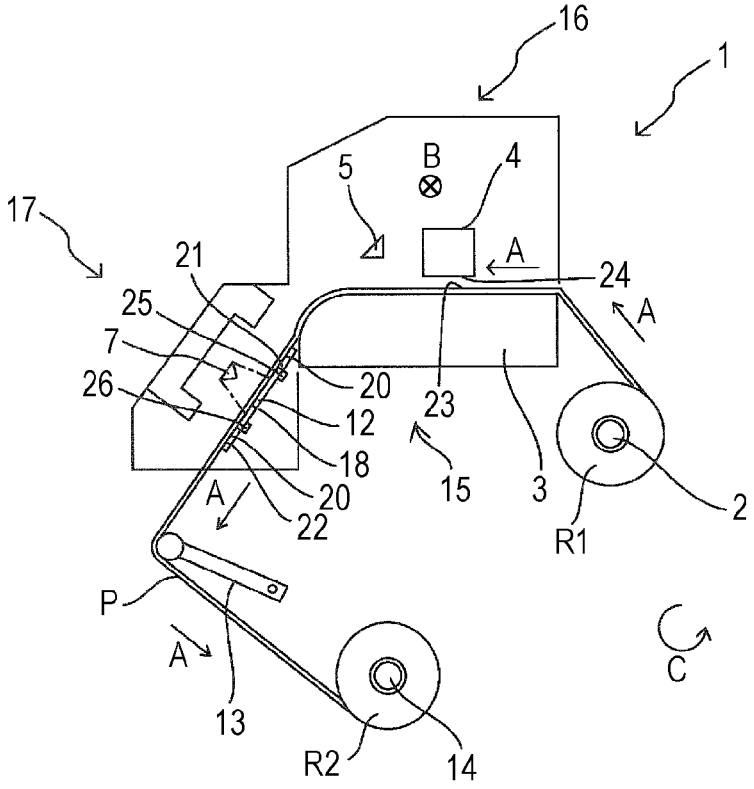
FIG. 1 is a schematic side view illustrating a recording apparatus according to a first embodiment of the invention.

FIG. 1 illustrates a schematic side view of a recording apparatus 1 according to the embodiment.

The recording apparatus 1 of the embodiment includes a set section 2 that sets a roll R1 to be capable of feeding a recording medium P for performing the recording. Moreover, the recording apparatus 1 of the embodiment uses a roll type recording medium as the recording medium P, but is not limited to the recording apparatus using the roll type recording medium. For example, the recording apparatus may use a single sheet type recording medium.

In the recording apparatus 1 of the embodiment, when transporting the recording medium P in a transportation direction A, the set section 2 rotates in a rotation direction C.

Further, the recording apparatus 1 of the embodiment includes a transportation mechanism 15 having a plurality of transportation rollers (not illustrated) for transporting the roll type recording medium P in the transportation direction A in the vicinity of a platen 3. The set section 2 rotates in the rotation direction C, the plurality of transportation rollers (not illustrated) of the transportation mechanism 15 rotate and a winding section 14 described below rotates in the rotation direction C, thereby transporting the recording medium P in the transportation direction A. A moving route of the recording medium P in the transportation is a transportation route of the recording medium P.

Further, the recording apparatus 1 of the embodiment includes a recording mechanism 16 that performs recording by allowing scanning a recording head 4 to reciprocally scan in a scanning direction B crossing the transportation direction A of the recording medium P. The recording head 4 performs the recording by ejecting ink from nozzles to the recording medium P in a recording region 23 in the transportation route of the recording medium P by the transportation mechanism 15. An image is formed (recorded) on the recording medium P by the ink ejected from the recording head 4. Moreover, the recording apparatus 1 of the embodiment includes the recording mechanism 16 that performs the recording by reciprocally moving the recording head 4, but may be a recording apparatus including a so-called line head in which a plurality of nozzles ejecting the ink are provided in a direction crossing the transportation direction A.

Here, the term "line head" means a recording head used in the recording apparatus in which a region of the nozzles formed in the direction crossing the transportation direction A of the recording medium P is provided to be capable of covering an entirety of the recording medium P in the cross direction, one of the recording head and the recording medium is fixed and the other is moved thereby forming the image. Moreover, the region of the nozzles of the line head in the cross direction may be not capable of covering all recording media P in the cross direction, in the recording apparatus.

Further, in the embodiment, the transportation direction A corresponds to a longitudinal direction of the recording medium P and the cross direction (the scanning direction B) crossing the transportation direction A corresponds to a lateral direction of the recording medium P.

Further, here, a region facing the recording head 4 when performing the recording on the recording medium P is the recording region 23, and specifically, a region facing a configuration region of the nozzles (not illustrated) ejecting the ink provided on a nozzle forming surface 24 of the recording head 4 is the recording region 23. Moreover, in order to evaporate a portion of volatile components of the ink ejected onto the recording medium P in the recording region 23, an electromagnetic wave irradiation type platen heater 5 irradiating electromagnetic waves such as infrared rays capable of heating the recording region 23 to 50° C. to 60° C. is provided in the recording mechanism 16.

As the electromagnetic waves, the infrared rays are preferably used and a wavelength thereof is 0.76 μm to 1000 μm. In general, the infrared rays are further divided into near infrared rays, mid-infrared rays and far infrared rays according to the wavelength, and even though definitions of the division may vary, wavelength regions thereof are approximately 0.78 μm to 2.5 μm, 2.5 μm to 4.0 μm and 4.0 μm to 1000 μm. Particularly, the mid-infrared rays are preferably used.

A drying mechanism 17 is provided on the downstream side of the recording head 4 in the transportation direction A of the recording medium P. The drying mechanism 17 includes an electromagnetic wave irradiation section 7 capable of irradiating the electromagnetic waves such as infrared rays on the recording medium P on which the recording is performed by the recording head 4. Further, the drying mechanism 17 includes a first medium support section 12 that supports the recording medium P in the support region including an irradiation region 18 of the electromagnetic waves of the electromagnetic wave irradiation section 7 and a non-irradiating region 20. The first medium support section 12 is a medium support section which is provided with an opening section 19 (see FIG. 2) through which vapor evaporated from the ink ejected onto the recording medium P by being heated to 100° C. to 120° C. by the electromagnetic wave irradiation of the electromagnetic wave irradiation section 7 passes. Here, in the first medium support section 12, the irradiation region 18 to which the electromagnetic waves are irradiated from the electromagnetic wave irradiation section 7 and the non-irradiating region 20 to which the electromagnetic waves are not irradiated are generated. If the first medium support section 12 is manufactured by using a material having a high thermal conductivity, a ratio of heat that is released with respect to the heat transferred from the irradiation region 18 is increased in the non-irradiating region 20, and a temperature difference between the irradiation region 18 and the non-irradiating region 20 is increased. Since the dew condensation of the vapor evaporated from the ink is likely to occur at a portion with a low temperature in a portion having a high temperature change property, when the temperature difference between the irradiation region 18 and the non-irradiating region 20 is increased, the dew condensation is likely to occur in the non-irradiating region 20 in which the temperature is low. Particularly, the dew condensation is likely to occur in a portion of the first medium support section 12 facing the recording medium.

In the irradiation region 18, the ink ejected is heated to approximately 100° C. to 120° C. by the electromagnetic wave irradiation of the electromagnetic wave irradiation section 7. Then, a second medium support section 21 and a second medium support section 22 are respectively provided adjacent to the first medium support section 12 on the upstream side of the first medium support section 12 in the transportation direction A and on the downstream side of the first medium support section 12 in the transportation direction A.

In the recording apparatus 1 of the embodiment, a thermal insulation material 25 and a thermal insulation material 26 are respectively provided in an end section on the upstream side of the first medium support section 12 in the transportation direction A and in an end section on the downstream side of the first medium support section 12 in the transportation direction A. Then, a portion in which the thermal insulation materials 25 and 26 are not provided in the first medium support section 12 configures a first region 27, and a portion in which the thermal insulation materials 25 and 26 are provided configures second region 28 (see FIG. 3). In other words, the first medium support section 12 has the first region 27 which includes the irradiation region 18 and the second region 28, of which the thermal conductivity is lower than that of the first region 27 and which includes the non-irradiating region 20 (see FIG. 3).

Moreover, the first medium support section 12 of the embodiment is configured such that a support surface of the recording medium in the second region 28 and a support surface of the first region 27 are formed of the same configuration material, and the thermal insulation materials 25 and 26 are provided on the opposite side of the support surface of the second region 28. However, the first region 27 and the second region 28 may be formed by configuration materials having different thermal conductivity from each other without providing the thermal insulation material or the like.

Here, in the recording apparatus 1 of the embodiment, the thermal insulation materials 25 and 26 are provided in the end sections on the upstream side and the downstream side of the first medium support section 12 in the transportation direction A, thereby configuring the second region 28. However, the recording apparatus 1 is not limited to the configuration and may be configured such that the first region 27 that includes the irradiation region 18 and the second region 28 which is provided in the vicinity of the first region 27, of which the thermal conductivity is lower than that of the first region 27, and which includes the non-irradiating region 20 are provided in any region of the first medium support section 12.

Here, the first region 27 including the irradiation region 18 is sufficient for including at least a part of the irradiation region 18 and may include the non-irradiating region 20. Further, the second region 28 including the non-irradiating region 20 may include the irradiation region 18 as long as at least a region that is the non-irradiating region 20 and in which the dew condensation is likely to occur is included.

Further, a tension adjustment section 13 having a role of adjusting the tension of the recording medium P when winding the recording medium P is provided on the downstream side of the drying mechanism 17 in the transportation direction A of the recording medium P. Then, the winding section 14 capable of winding the recording medium P is provided on the downstream side of the tension adjustment section 13 in the transportation direction A of the recording medium P. Moreover, in the recording apparatus 1 of the embodiment, the winding section 14 rotates in the rotation direction C when forming a roll R2 of the recording medium P.

Next, the medium support section will be described in more detail.

Figure 2:
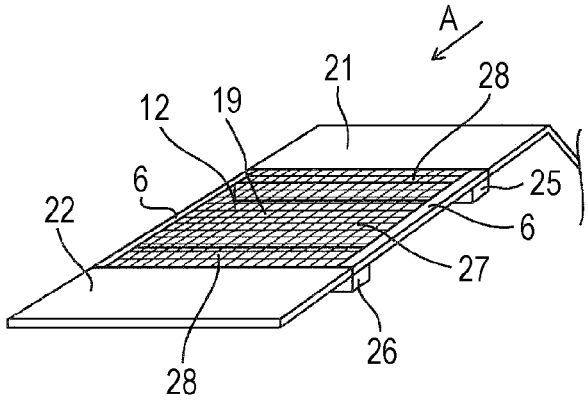
FIG. 2 is a schematic perspective view illustrating a medium support section in the recording apparatus according to the first embodiment of the invention.

FIG. 2 is a schematic perspective view illustrating the medium support section in the recording apparatus 1 of the embodiment.

The opening section 19 is provided in the first medium support section 12. That is, the opening section 19 is provided through which the vapor evaporated from the ink ejected onto the recording medium P passes from the side of the recording medium P to the opposite side thereof with respect to the first medium support section 12. The opening section 19 has a role of allowing the vapor evaporated pass from the ink from one surface side to the other surface side of the first medium support section 12.

It is possible to release the vapor evaporated from the ink by the electromagnetic wave irradiation, through the opening section 19 in the direction away from a portion of the first medium support section 12 facing the recording medium P, that is, from a contact region between the first medium support section 12 and the recording medium P by providing the opening section 19. Therefore, it is possible to easily reduce existence amount of the vapor that is a source of the dew condensation in the periphery of the medium support section and then the dew condensation is unlikely to occur in the periphery of the medium support section. Further, an outer frame 6 serving as a reinforcing member is provided in the first medium support section 12.

The shape and the like of the opening section 19 is not particularly limited and may be circular, polygonal and the like as long as the opening section 19 is capable of allowing the vapor to pass.

As a preferable configuration example of the opening section 19, a quadrangle in which linear members, of which a diameter of at least a part thereof is 0.3 mm or less are configured to be arranged in a grid shape is exemplified. A region having a certain area is necessary for the dew condensation of the vapor. Since the area of the portion other than the opening section can be reduced by configuring the opening section using the linear members, of which the diameter of at least a part thereof is 0.3 mm or less, it is possible to reduce the region of the certain area and it is possible to suppress the dew condensation of the vapor with high accuracy in the contact portion of the first medium support section 12 with the recording medium P.

Further, an opening rate of the opening section 19 with respect to the first medium support section 12 is preferably 40% or greater. It is because that it is possible to suppress the dew condensation of the vapor with high accuracy in the first medium support section 12.

The thermal insulation materials 25 and 26 are provided in the end sections on the upstream side and the downstream side of the first medium support section 12 in the transportation direction A throughout a direction crossing the transportation direction A on the opposite side of the side in which the first medium support section 12 supports recording medium. Then, in the first medium support section 12, a portion in which the thermal insulation materials 25 and 26 are not provided configures the first region 27 and a portion in which the thermal insulation materials 25 and 26 are provided configures the second region 28, of which the thermal conductivity is lower than that of the first region 27.

As described above, the recording apparatus 1 of the embodiment is configured such that the first region 27 including the irradiation region 18 and the second region 28 including the non-irradiating region 20, of which the thermal conductivity is lower than that of the first region 27, are provided to be adjacent to each other. Thus, it is possible to suppress the dew condensation of the vapor evaporated from the ink by the electromagnetic wave irradiation in the medium support section. This is because the first region 27 includes the irradiation region 18 so that the temperature thereof is likely to be increased and the dew condensation is unlikely to occur, and the second region 28 includes the region that is the non-irradiating region 20 in which the dew condensation is likely to occur, but in which thermal conductivity is lower than that of the first region 27 and thus the second region 28 becomes a state where the dew condensation is unlikely to occur. Therefore, it is possible to suppress the dew condensation of the vapor evaporated from the ink by the electromagnetic wave irradiation in the medium support section by combination of the first region 27 (including the irradiation region) and the second region 28 (having the thermal conductivity lower than that of the first region 27 and including the non-irradiating region 20).

The recording apparatus 1 of the embodiment is the recording apparatus including the transportation mechanism 15 of the recording medium P and is configured such that the second region 28 is provided in the vicinity of both sides of the first region 27 in the transportation direction A. Thus, in the recording apparatus including the transportation mechanism of the recording medium, it is possible to effectively suppress the dew condensation of the vapor evaporated from the ink by the electromagnetic wave irradiation in the medium support section. However, in order to have such an effect, the second region only has to be provided in the vicinity of at least one side of the first region in the transportation direction A and is not limited to be provided in the vicinity of the both sides of the first region in the transportation direction A.

Figure 3:
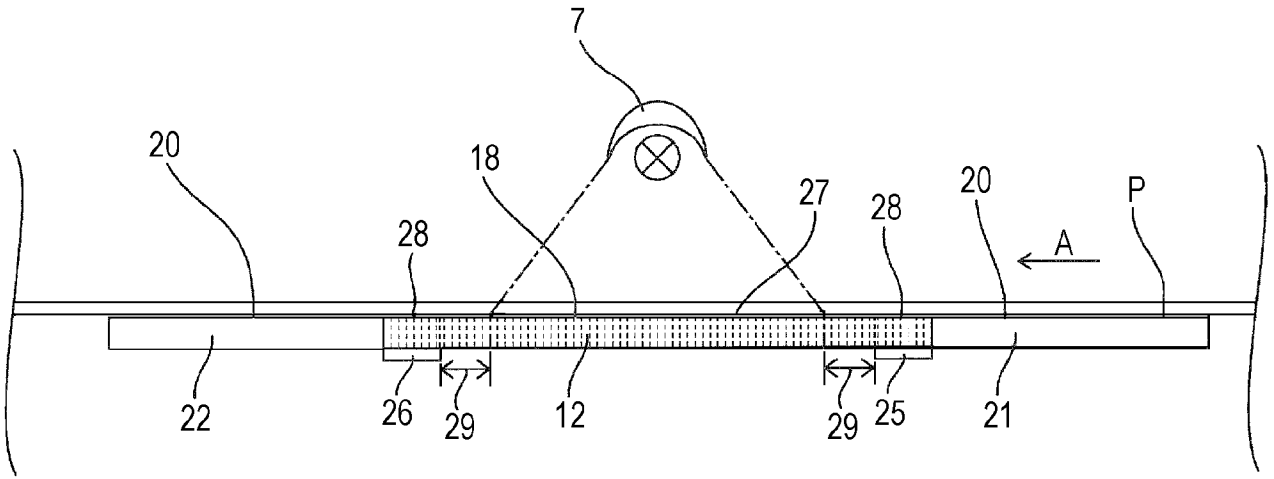
FIG. 3 is a schematic side view illustrating the medium support section in the recording apparatus according to the first embodiment of the invention.
Figure 4:
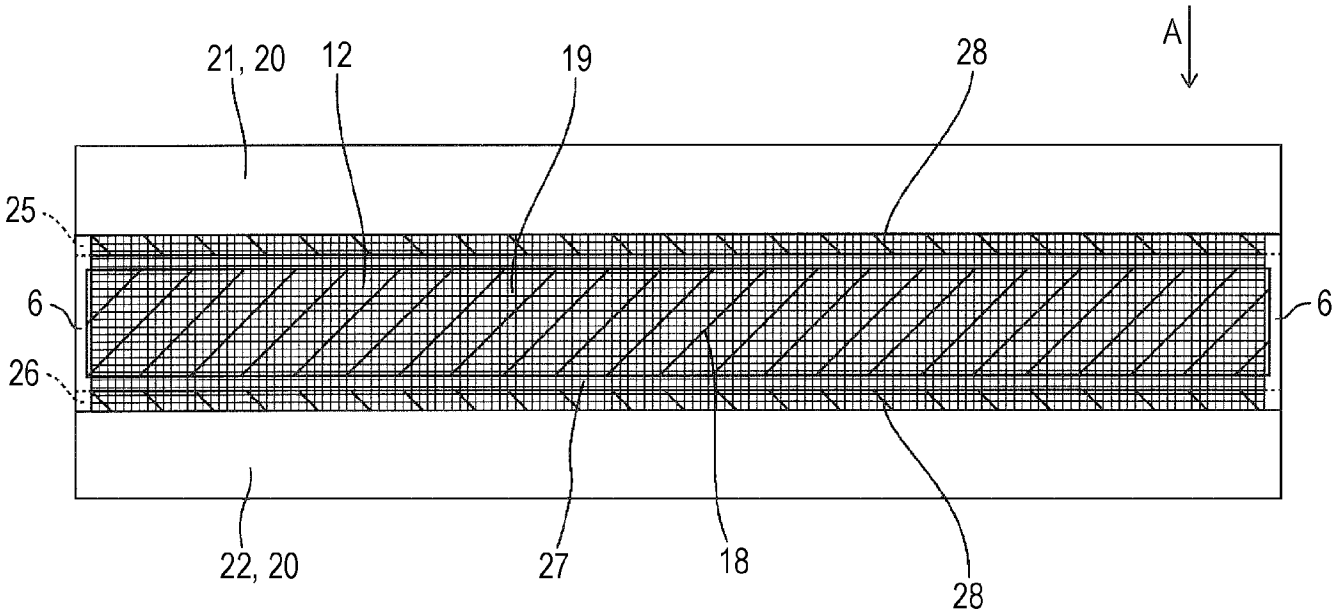
FIG. 4 is a schematic plan view illustrating the medium support section in the recording apparatus according to the first embodiment of the invention.

FIG. 3 is a schematic side view illustrating the medium support section in the recording apparatus 1 of the embodiment. Further, FIG. 4 is a schematic plan view illustrating the medium support section in the recording apparatus 1 of the embodiment.

Moreover, as illustrated in FIGS. 1 and 2, the medium support section (the first medium support section 12, and the second medium support sections 21 and 22) is provided to be inclined viewed from the side surface of the recording apparatus 1, but in order to simplify the description, FIG. 3 is a view horizontally illustrating the medium support section.

The first medium support section 12 of the embodiment is configured such that the thermal insulation material 25 is provided in the end section on the upstream side in the transportation direction A and the thermal insulation material 26 is provided in the end section on the downstream side of the first medium support section 12 in the transportation direction A. Thus, in the first medium support section 12, the second region 28 in which the thermal insulation materials 25 and 26 are provided has the thermal conductivity lower than that of the first region 27 in which the thermal insulation materials 25 and 26 are not provided.

Further, the first region 27 in which the thermal insulation materials 25 and 26 are not provided to include both the irradiation region 18 and the non-irradiating region 20. Meanwhile, the second region 28 in which the thermal insulation materials 25 and 26 are provided is positioned on the outside of the irradiation region 18 to include only the non-irradiating region 20. However, the invention is not limited to the configuration and the first region 27 may not include the non-irradiating region 20 as long as the first region 27 includes the irradiation region 18, and the second region 28 may include the irradiation region 18 as long as the second region 28 includes at least the region that is the non-irradiating region 20 and in which the dew condensation is likely to occur.

Further, in the first medium support section 12 of the embodiment, the thermal insulation materials 25 and 26 are provided in positions in which the temperature of the thermal insulation materials 25 and 26 when irradiating the electromagnetic waves by the electromagnetic wave irradiation section 7 is lower than a flash point of a liquid droplet that is generated by the dew condensation of the vapor evaporated from ink ejected onto the recording medium P. Thus, even if the vapor evaporated from the ink is condensed in the thermal insulation materials 25 and 26, since the liquid droplet that is generated by the dew condensation is not flammable, safety is high.

Moreover, here, for example, the term "the flash point of the liquid droplet generated by the dew condensation of the vapor" corresponds to a flash point of contained components of the ink and, specifically, corresponds to the lowest flash point of the contained components of the ink.

Further, it is possible to verify whether or not the thermal insulation material is provided in a position in which the temperature thereof is lower than the flash point of the liquid droplet by measuring the temperature of the thermal insulation material with a non-contact type thermometer or the like when irradiating the electromagnetic waves by the electromagnetic wave irradiation section 7.

Meanwhile, since the effect of suppressing the dew condensation is reduced if a distance 29 from the irradiation region 18 to the second region 28 is increased, the distance 29 is preferably 20 mm or less. Here, the distance 29 is a gap between the irradiation region 18 and the second region 28 and is the shortest distance between the irradiation region 18 and the second region 28.

Here, the thermal insulation materials 25 and 26 are not specifically limited for shapes or configuration materials thereof and it is possible to preferably use those having the thermal conductivity of less than 0.1 W/(m·K). Since such a thermal insulation material can effectively lower the thermal conductivity of the second region 28, it is possible to effectively suppress the dew condensation of the vapor evaporated from the ink by the electromagnetic wave irradiation in the medium support section.

Moreover, as such a thermal insulation material, a fiber-based thermal insulation material, a foam resin thermal insulation material or the like can be used. As the fiber-based thermal insulation material, for example, glass wool, rock wool, cellulose fiber and the like can be preferably used. Further, as the foam resin thermal insulation material, for example, urethane foam and the like can be preferably used. It is because the thermal conductivity of those thermal insulation materials is easily lowered to less than 0.1 W/(m·K) and workability thereof is also excellent.

In the recording apparatus 1 of the embodiment, lengths of the first medium support section 12 and the second medium support sections 21 and 22 in the cross direction crossing the transportation direction A correspond to the maximum width of the recording medium of which use is contemplated.

Here, the term "the maximum width of the recording medium of which use is contemplated" means, for example, the maximum width of a recording medium that is usable, a recording medium that is recommended and the like which are described in an instruction manual or the like of the recording apparatus.

Further, the term "correspond to the maximum width of the recording medium of which the use is contemplated" means being equal to or greater than the maximum width of the recording medium of which the use is contemplated and, "being equal" includes a case of being slightly shorter than the maximum width of the recording medium of which the use is contemplated.

Further, as represented by the irradiation region 18 of the electromagnetic waves of the electromagnetic wave irradiation section 7 in FIG. 4, an irradiation length of the electromagnetic waves of the electromagnetic wave irradiation section 7 in the cross direction crossing the transportation direction A corresponds to the length of the first medium support section 12 in the cross direction.

Here, the term "the length of the first medium support section 12 in the cross direction" may be a length including the length of the outer frame 6 if the first medium support section 12 has the outer frame 6 and the like as the embodiment, and may be a length of a region provided with the opening section excluding the length of the outer frame 6.

Further, the term "corresponding to the length of the first medium support section 12 in the cross direction" means being equal to or greater than the length of the first medium support section 12 in the cross direction and, "being equal" includes a case of being slightly shorter than the length of the first medium support section 12 in the cross direction.

In the recording apparatus 1 of the embodiment, the irradiation length of the electromagnetic waves of the electromagnetic wave irradiation section 7 in the cross direction corresponds to the length of the first medium support section 12 in the cross direction. It is possible to reduce a temperature distribution of the first medium support section 12 in the cross direction, that is, a portion in which the temperature difference is great does not occur, and then it is possible to suppress occurrence of the dew condensation in the end section and the like of the first medium support section 12 in the cross direction.

Further, from the above, it may be recognized that in the recording apparatus 1 of the embodiment, the irradiation length of the electromagnetic waves of the electromagnetic wave irradiation section 7 in the cross direction corresponds to the maximum width of the recording medium of which the use is contemplated. Thus, it is possible to reduce the temperature distribution of the first medium support section 12 in the cross direction, that is, the portion in which the temperature difference is great does not occur, and then it is possible to suppress occurrence of the dew condensation in the end section and the like of the first medium support section 12 in the cross direction.

Further, the recording apparatus 1 of the embodiment is configured such that a contact angle in the second medium support sections 21 and 22 with a liquid droplet generated by the dew condensation of the vapor evaporated from the ink ejected onto the recording medium P by the electromagnetic wave irradiation of the electromagnetic wave irradiation section 7 is greater than that with the liquid droplet in the first medium support section 12.

The contact angle with the liquid droplet being great means that the liquid droplet is likely to be repelled (unlikely to get wet) and that the liquid droplet is unlikely to condense. That is, the first medium support section 12 gets wet more easily than the second medium support sections 21 and 22 (the vapor is likely to condense), but since the first medium support section 12 is provided with the opening section 19, it is possible to release the vapor. Therefore, in the recording apparatus 1 of the embodiment, it is possible to suppress the dew condensation of the vapor in all of the first medium support section 12, and the second medium support sections 21 and 22 by specifying the contact angle, and it is possible to further suppress the dew condensation of the vapor evaporated from the ink by the electromagnetic wave irradiation in the medium support section.

Figure 5:
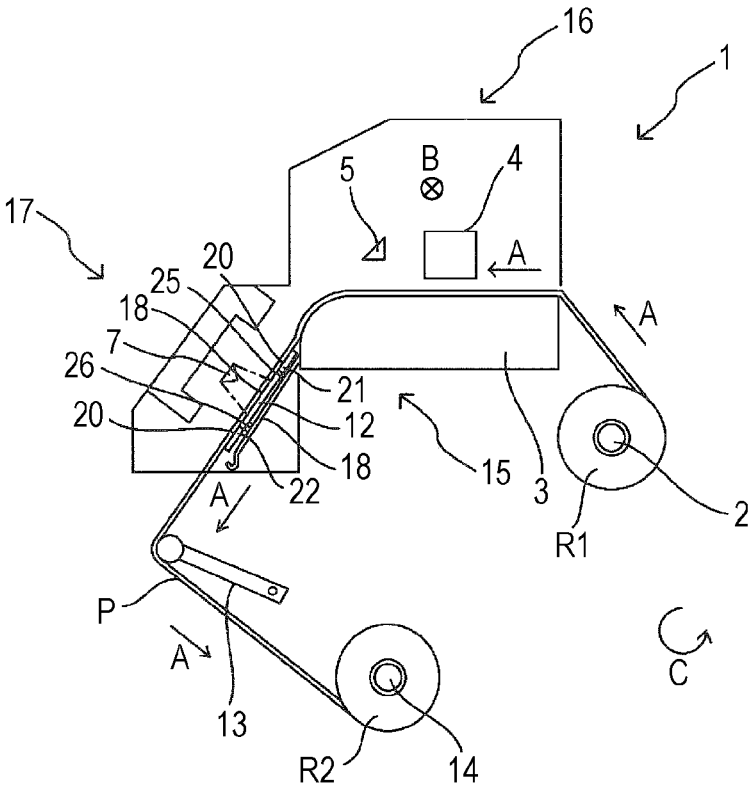
FIG. 5 is a schematic side view illustrating a recording apparatus according to a second embodiment of the invention.
Figure 6:
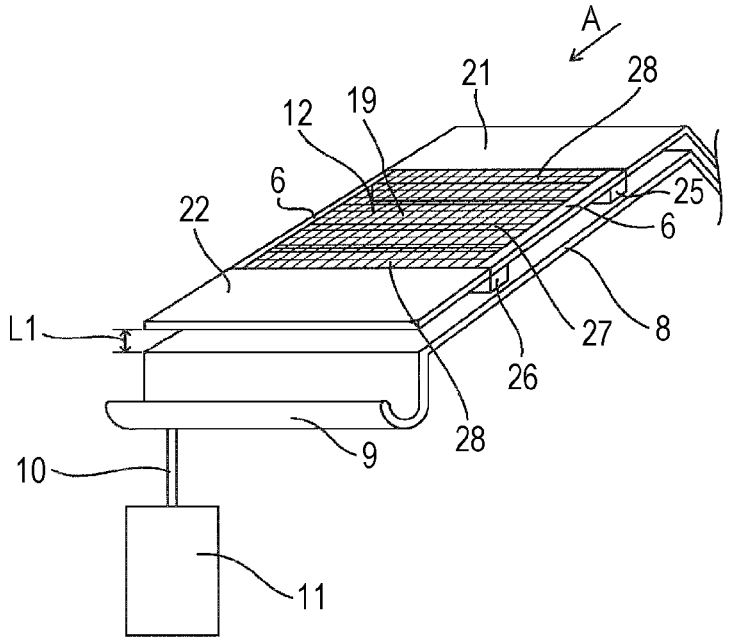
FIG. 6 is a schematic perspective view illustrating a medium support section and a dew condensation section in the recording apparatus according to the second embodiment of the invention.

Second Embodiment, FIGS. 5 and 6

Hereinafter, a recording apparatus of a second embodiment is described in detail with reference to the accompanying drawings.

FIG. 5 illustrates a schematic side view of the recording apparatus 1 of a second embodiment. Further, FIG. 6 illustrates the medium support section and the dew condensation section in the recording apparatus 1 of the second embodiment. Moreover, the same reference numerals are given to the common configuration members with the first embodiment and the detailed description thereof is omitted.

Moreover, the recording apparatus of the second embodiment is different from the recording apparatus of the first embodiment in that a dew condensation section 8 is provided in a lower section of the first medium support section 12 and the second medium support sections 21 and 22 in the drying mechanism 17.

The drying mechanism 17 of the second embodiment includes the dew condensation section 8, of which the thermal conductivity is higher than that of the first medium support section 12 and the second medium support sections 21 and 22, and which condenses the vapor passing through the opening section 19.

Here, the dew condensation section 8 is configured such that the vapor contacting with the surface thereof is more easily condensed than in the medium support section during a drying process. Specifically, for example, the dew condensation section 8 is made of a material such as an aluminum alloy having a high thermal conductivity, and is configured to have a low temperature to cause further dew condensation.

According to the second embodiment, the vapor evaporated from the ink reaches the dew condensation section 8 through the opening section 19 and is positively condensed in the dew condensation section 8.

Therefore, it is possible to condense the vapor in the dew condensation section 8 before the vapor evaporated from the ink is condensed in the first medium support section 12 and the second medium support sections 21 and 22. That is, it is possible to more effectively suppress the dew condensation of the vapor evaporated from the ink by the electromagnetic wave irradiation in the first medium support section 12 and the second medium support sections 21 and 22.

However, the dew condensation section 8 is not limited to have the above configuration and if the thermal conductivity of the dew condensation section 8 is higher than that of the second region 28, it is possible to positively condense the vapor in the dew condensation section 8, and it is possible to effectively suppress the dew condensation in the second region 28.

Further, the dew condensation section 8 of the embodiment is provided facing the opening section 19 and is a configuration member for condensing the vapor passing through the opening section 19, and as illustrated in FIG. 6, a liquid receiver 9 receiving the liquid droplet caused by the dew condensation of the vapor is provided in a lower section thereof. Further, a liquid waste bottle 11 for recovering the liquid collected in the liquid receiver 9 through a tube 10 is provided in the lower section of the liquid receiver 9.

Further, temperature conductivity in the dew condensation section 8 is preferably higher than that in the first medium support section 12. Since the temperature conductivity is obtained by dividing the thermal conductivity by density and specific heat, if the temperature conductivity of the dew condensation section 8 is higher than that of the first medium support section 12, the dew condensation section 8 tends to be a temperature lower than that of the first medium support section 12, in which the heat is likely to be released. Thus, the dew condensation section 8 and the first medium support section 12 has a temperature conductivity relationship such that it is possible to suppress the dew condensation of the vapor with high accuracy in the first medium support section 12 similar to in the case where the thermal conductivity in the dew condensation section 8 is higher than that in the first medium support section 12.

Further, it is preferable that the contact angle of the dew condensation section 8 with the liquid droplet generated by the dew condensation of the vapor be smaller than that of the first medium support section 12. Since the dew condensation section 8 is more likely to get wet than the first medium support section 12, it is possible to suppress the dew condensation of the vapor with high accuracy in the first medium support section 12.

Further, the dew condensation section 8 of the embodiment is disposed so that a gap L1 (FIG. 6) between the first medium support section 12 and the second medium support sections 21 and 22 becomes 2 mm or more and 20 mm or less and such disposition is preferable. Here, if the gap L1 between the first medium support section 12 and the second medium support sections 21 and 22 is not constant, the gap L1 is preferably 2 mm or more and 20 mm or less in any portion. It is possible to suppress attachment of the liquid droplet condensed in the dew condensation section 8 to the first medium support section 12 and the second medium support sections 21 and 22 by making the gap 2 mm or more between the dew condensation section 8 and the first medium support section 12, and the second medium support sections 21 and 22. Then, it is possible to suppress the dew condensation of the vapor with high accuracy in the first medium support section 12 and the second medium support sections 21 and 22 by making the gap 20 mm or less between the dew condensation section 8 and the first medium support section 12, and the second medium support sections 21 and 22.

As illustrated in the first and second embodiments described above, the recording apparatus according to the embodiment of the invention has the medium support section (the first medium support section 12) that supports the recording medium P and the electromagnetic wave irradiation section 7 that dries the ink present on the recording medium P by irradiating the electromagnetic waves on the recording medium P on the first medium support section 12. The first medium support section 12 has the first region 27 including the irradiation region 18 of the electromagnetic wave irradiation section 7 and the second region 28 provided adjacent to the first region 27, having the thermal conductivity lower than that of the first region 27, and including the non-irradiating region 20 of the electromagnetic wave irradiation section 7, and is provided with the opening section 19 through which the vapor evaporated from the ink passes.

Since the opening section 19 through which the vapor evaporated from the ink passes is provided in the medium support section (the first medium support section 12), it is possible to release the vapor evaporated from the ink by the electromagnetic wave irradiation, through the opening section 19, in a direction away from the portion of the first medium support section 12 facing the recording medium P, that is, the contact region between the first medium support section 12 and the recording medium P. Therefore, it is possible to easily reduce existence amount of the vapor that is the source of the dew condensation in the periphery of the first medium support section 12 and then the periphery of the first medium support section 12 becomes a state where the dew condensation is unlikely to occur.

Then, the first medium support section 12 has the first region 27 which includes the irradiation region 18 and the second region 28 which has the thermal conductivity lower than that of the first region 27 and includes the non-irradiating region 20. The temperature of the first region 27 is easily increased and the dew condensation is unlikely to occur in the first region 27 because the first region 27 includes the irradiation region 18. Further, the second region 28 includes the region that is the non-irradiating region 20 and in which the dew condensation is likely to occur, but since the thermal conductivity thereof is lower than that of the first region 27, it is in a state where the dew condensation is unlikely to occur.

Therefore, it is possible to suppress the dew condensation of the vapor evaporated from the ink by the electromagnetic wave irradiation in the first medium support section 12 by combining the first region 27 (including the irradiation region 18) of the first medium support section 12 and the second region 28 (having the thermal conductivity lower than that of the first region 27 and including the non-irradiating region 20) of the first medium support section 12.

Moreover, the term "suppressing the dew condensation" does not mean to condensation of the vapor in all of medium support section, and is used to mean to suppress the condensation of the vapor to the extent that the dew condensation is not recognized as contamination even if the liquid that is condensed in the medium support section is attached to the recording medium.

Further, in other words, the drying method of the invention is the drying method including drying ink by performing the electromagnetic wave irradiation on the ink present on the recording medium P, in which the drying is performed on the medium support section which has the first region including the electromagnetic wave irradiation region and the second region provided adjacent to the first region, having the thermal conductivity lower than that of the first region, and including the electromagnetic wave non-irradiating region and which is provided with the opening section through which the vapor evaporated from the ink by the electromagnetic wave irradiation passes.

It is possible to suppress the contamination of the recording medium P due to the dew condensation of the vapor evaporated from the ink by the electromagnetic wave irradiation in the first medium support section 12 by having such a characteristic.

The entire disclosure of Japanese Patent Application No. 2013-157132, filed Jul. 29, 2013 is expressly incorporated by reference herein.

What is claimed is:

1. A recording apparatus comprising:

a medium support section that supports a recording medium; and an electromagnetic wave irradiation section that dries ink present on the recording medium by irradiating electromagnetic waves to the recording medium on the medium support section, wherein the medium support section has a first region including an irradiation region of the electromagnetic wave irradiation section and a second region provided adjacent to the first region, having thermal conductivity lower than that of the first region, and including a non-irradiating region of the electromagnetic wave irradiation section, and is provided with an opening section through which vapor evaporated from the ink passes.

2. The recording apparatus according to claim 1, wherein the second region is provided adjacent to at least one side of the first region in a longitudinal direction of the recording medium.

3. The recording apparatus according to claim 1, wherein the second region is provided with a thermal insulation material.

4. The recording apparatus according to claim 3, wherein the thermal insulation material is provided in a position of which the temperature is lower than a flash point of a liquid droplet generated by dew condensation of the vapor when irradiating the electromagnetic waves.

5. The recording apparatus according to claim 2, wherein the thermal insulation material has thermal conductivity of less than 0.1 W/(m·K).

6. The recording apparatus according to claim 1, further comprising:

a dew condensation section in which the vapor passed through the opening section is condensed.

7. The recording apparatus according to claim 6, wherein the dew condensation section is provided facing the opening section and the thermal conductivity of the dew condensation section is higher than that of the second region.

8. The recording apparatus according to claim 1, wherein an irradiation length of electromagnetic waves of the electromagnetic wave irradiation section in a lateral direction of the recording medium is equal to or greater than a length of the medium support section in the lateral direction.

9. A drying method comprising:

drying ink by performing electromagnetic wave irradiation on the ink present on a recording medium, wherein the drying is performed on a medium support section which has a first region including an electromagnetic wave irradiation region, and a second region provided adjacent to the first region, having thermal conductivity lower than that of the first region, and including an electromagnetic wave non-irradiating region and which is provided with an opening section through which vapor evaporated from the ink by the electromagnetic wave irradiation passes.

* * * * *